US008794137B2

(12) United States Patent
Riemer

(10) Patent No.: US 8,794,137 B2
(45) Date of Patent: Aug. 5, 2014

(54) SUPPORT WITH WEARING PARTS FOR SCREW PRESSES

(75) Inventor: Hubert Riemer, St. Oswald (AT)

(73) Assignee: Andritz AG, Graz (AT)

( * ) Notice: Subject to any disclaimer, the term of this patent is extended or adjusted under 35 U.S.C. 154(b) by 932 days.

(21) Appl. No.: 12/227,172

(22) PCT Filed: May 3, 2007

(86) PCT No.: PCT/AT2007/000207

§ 371 (c)(1),
(2), (4) Date: Aug. 2, 2010

(87) PCT Pub. No.: WO2007/128017

PCT Pub. Date: Nov. 15, 2007

(65) Prior Publication Data

US 2010/0288141 A1 Nov. 18, 2010

(30) Foreign Application Priority Data

May 8, 2006 (AT) ..... A 789/2006

(51) Int. Cl.
*B30B 9/14* (2006.01)
*B30B 9/12* (2006.01)

(52) U.S. Cl.
CPC ..... *B30B 9/121* (2013.01)
USPC ..... 100/117; 100/145; 100/150

(58) Field of Classification Search
USPC ..... 100/110, 117, 126, 145, 150, 904
See application file for complete search history.

(56) References Cited

U.S. PATENT DOCUMENTS

| | | | | | |
|---|---|---|---|---|---|
| 3,127,757 | A | * | 4/1964 | Weiss | 63/15.7 |
| 3,764,062 | A | * | 10/1973 | Brautigam | 494/54 |
| 3,977,515 | A | * | 8/1976 | Lewoczko | 198/677 |
| 4,466,533 | A | * | 8/1984 | Shwayder | 198/676 |
| 4,475,452 | A | * | 10/1984 | Koch et al. | 100/117 |
| 4,509,419 | A | * | 4/1985 | Koch et al. | 100/117 |
| 4,519,496 | A | * | 5/1985 | Ludvigsen | 198/676 |
| 4,772,125 | A | * | 9/1988 | Yoshimura et al. | 356/237.1 |
| 5,009,586 | A | * | 4/1991 | Pallmann | 425/311 |
| 5,272,967 | A | * | 12/1993 | Held | 100/311 |
| 5,647,831 | A | * | 7/1997 | Schroeder | 492/38 |
| 5,673,618 | A | * | 10/1997 | Little | 100/145 |
| 7,467,585 | B2 | * | 12/2008 | Pallmann | 100/145 |
| 2005/0022362 | A1 | * | 2/2005 | Chen | 29/521 |
| 2006/0283340 | A1 | * | 12/2006 | Pallmann | 100/117 |

FOREIGN PATENT DOCUMENTS

DE 3723335 A1 * 1/1989

* cited by examiner

*Primary Examiner* — Jimmy T Nguyen
(74) *Attorney, Agent, or Firm* — Alix, Yale & Ristas, LLP

(57) ABSTRACT

A screw press (1) for removing liquid from a pulp suspension has a shell (2) which is provided with openings through which the liquid can pass. The shell (2) contains a rotating screw with a screw flight (4) to which wearing parts are attached. Wearing part (6) and support (7) are connected to one another in a substance-to-substance bond by a soldered joint and in a positive bond by a projection (8) located at one of the two parts and which meshes into a recess (9) in the other part.

11 Claims, 1 Drawing Sheet

SUPPORT WITH WEARING PARTS FOR SCREW PRESSES

BACKGROUND

The present invention relates to a support with at least one wearing part, particularly a wear shoe, for screw presses with a screw flight, where the support can be secured to the screw flight, where the wearing part is connected to the support by a positive and a substance-to-substance bond, and where the wearing part and the support are connected to one another by a positive bond in which a projection in one of the two parts meshes into a recess in the other part.

Furthermore, the invention relates to a screw press for removing liquid from a pulp suspension, which has a shell, having openings through which the liquid passes, and a screw with screw flight, to which supports with wearing parts are secured, rotating inside the shell.

For removal of liquids from pulp suspensions by means of screw presses the use of so-called wear shoes at the outer radial edges of the screw flight is itself known from the state of the art. Since screw presses have a high-pressure section, the operating conditions of the wear shoes are characterised by very strong forces acting on the wear shoes. As a result, the wear shoes must be connected to the screw flight with high precision. This connection was formed so far by welding, which led to undesirable stresses occurring.

DE 19820044C2 describes a wear shoe that is made of a similar or the same material as the screw flight in order to prevent uncontrollable material damage during welding as a result of different materials being used. Practical operation has demonstrated, however, that securing of wear shoes to the screw flight can be improved.

In addition, wearing parts for centrifuges are known, e.g. from WO 81/02853 and WO 95/24352. Here, in particular, the centrifugal forces must be taken into consideration, whereas in screw presses the pressing forces on the face end and the forces generated by friction in circumferential direction must be taken into account. Thus, the solution for centrifuges cannot be applied to screw presses.

DE 32 49 999 C1 shows a conventional screw press with wearing elements on a screw shaft. The screw flight is interrupted here and at this point, doctor-like screw flight tips are mounted, which have a wearing layer and a connected to one another either by a bolt or by welding. DE 42 12 217 A1 describes a device for attaching wearing elements to screw flights using adhesive.

SUMMARY

The object of the present invention is thus to provide a support with at least one wearing part for screw presses, as well as a screw press in which supports with wearing parts are mounted, where the wearing parts can be connected to the screw flight with high precision and withstand the operating conditions in the high-pressure section.

According to the present disclosure the support and the wearing part are connected to one another by a soldered joint in the region of the recess. This embodiment of the bond between screw flight and wearing part, which has very small dimensions in relation to the screw flight, can be exposed to very high loads because the positive bond transfers the forces reliably and the substance-to-substance bond provides adequate purchase. The wearing part here should preferably be made of hard metal. Due to the positive bond the wearing part can still be fastened securely even if the substance-to-substance bond is insufficient.

If the support is foreseen as a supporting strip on which several wearing parts are mounted, this yields advantages related in particular to manufacturing engineering because the bond can be formed with great accuracy and prefabrication of the parts mentioned can be achieved without great effort. In order to be able to absorb the forces particularly well and thus prevent the wearing part from detaching itself, as can easily happen with the rules stipulated by the state of the art, the recess has an enclosed perimeter.

Further details, characteristic features and advantages of the invention are described in the following description, referring to the attached drawings showing preferred embodiments.

DETAILED DESCRIPTION

Figure 1:
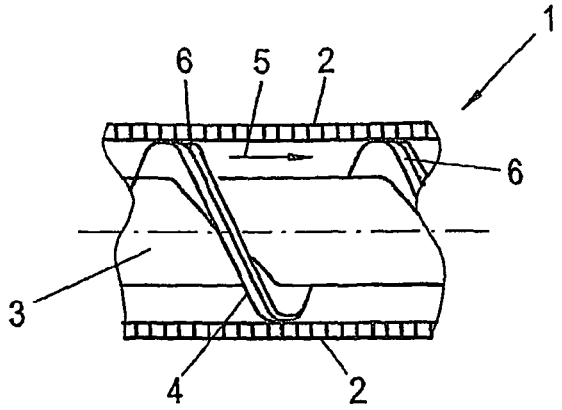
FIG. 1 shows a sectional view through part of a screw press.

In FIG. 1, sections of a screw press 1 for removing liquids from pulp suspensions are shown. The screw press 1 has a shell 2 that is provided with liquid passages through which the liquids pressed out of the pulp suspension pass to leave the screw press 1. A screw shaft 3, to which a screw flight 4 is attached, is mounted inside the shell 2. Wearing parts 6, particularly wear shoes, are arranged on the front side of the screw flight 4 in the movement direction (arrow 5) of the pulp suspension conveyed by the screw flight 4 and are secured to the screw flight 4 in the region of its outer radial edge.

The invention can be used essentially in all known screw presses for removing liquids from pulp suspensions, as are known, for example, from the screw press described in DE 197 15 173 C2.

Figure 2:
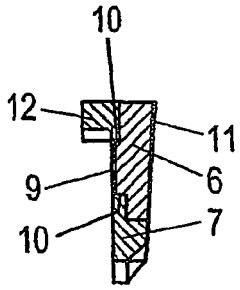
FIG. 2 shows an initial embodiment of the wearing part according to the invention.

FIG. 2 shows an initial embodiment of the wearing part 6 according to the invention, with a cross-section that converges largely in a wedge shape. The wearing part 6 is arranged on a support 7 shown as being angled in an L-shape and is connected to it by a positive and a substance-to-substance bond. The wearing part 6 does not converge fully to a point, however, but the face side of the narrower end (at the bottom in FIG. 2) rests against a nose projecting from the support 7. Wearing part 6 and support 7 are made of hard metal in the embodiment shown. In order to form a substance-to-substance bond, these parts are brazed together. Thus, parts made of different materials can also be bonded together well.

Figure 5:
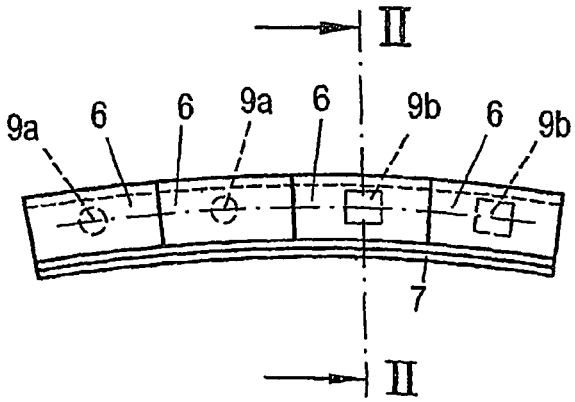
FIG. 5 shows wearing parts secured to a support.

The positive bond in this embodiment is achieved by a projection 8 at the wearing part 6 and which is formed by a pin that meshes into a recess 9 in the support 7. In addition, projection 8 and support 7 are connected in a substance-to-substance bond by means of a soldered joint 10 in the region of, i.e., at, the recess 9. The projection 8 and the recess 9 may have any desired cross-section, for example round 9*a* or polygonal 9*b* (FIG. 5). Within the scope of the invention it is important only that the shape of these two parts corresponds. In order to be able to transfer the forces occurring in screw presses well, the recess 9 is formed with an enclosed perimeter. As a result, it is possible to control the forces in circumferential direction without the wearing parts becoming detached and thus causing damage in the screw press or in subsequent units in the process.

The side of the wearing part 6 facing the projection 8 is designed for low wear and to be wear-resistant. For example, an additional layer 11 of a suitable material can be applied to this side. On the other hand, the wearing part 6 can also be made entirely of a wear-resistant material.

Figure 3:
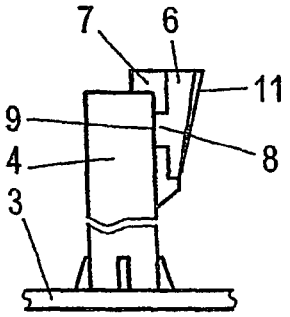
FIG. 3 shows the wearing part in FIG. 2 on a screw flight.
Figure 4:
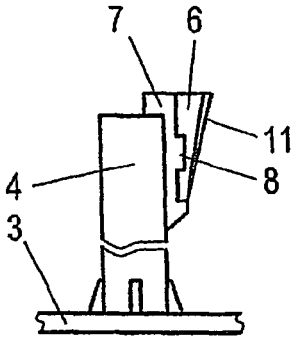
FIG. 4 shows a second embodiment of the wearing part according to the invention on a screw shaft.

As is shown in FIGS. 3 and 4, the angled part 12 of the support 7 rests against the screw flight 4 at its outer radial edge.

FIG. 4 shows an embodiment which is largely identical to the embodiment shown in FIG. 3. There is a difference, however, in that the projection 8 is located at the support 7 and the recess 9 is located in the wearing part 6. The projection 8 can be a pin, as described with reference to FIG. 2. Within the scope of the invention it is also possible that the projection 8 at the support 7 is formed by a strip extending in parallel to the screw flight 4.

Within the scope of the invention, the support 7 can be a supporting strip. In this case, several wearing parts 6 can be mounted side by side on the supporting strip, as illustrated in FIG. 5. Wearing parts 6 can either be connected to the support 7 individually, each by means of a pin, or together by means of the strip for example, (as described with reference to FIG. 4), in a positive bond.

Use of the support 7 according to the invention is not limited to the examples shown or explained. The support 7 can either be welded or spot-welded to the screw flight 4, or can also be bolted to it, for example.

In summary, an embodiment can be described as follows:

A screw press 1 for removing liquid from a pulp suspension has a shell 2, which is provided with openings through which the liquid can pass. The shell 2 contains a rotating screw with a screw flight 4 to which wearing parts 6 are attached.

Wearing part 6 and support 7 are connected to one another in a substance-to-substance bond by means of a soldered joint and in a positive bond by means of a projection 8 located at one of the two parts and which meshes into a recess 9 in the other part.

The invention claimed is:

1. A wear attachment for a front side of a screw flight of a screw press having an axis of rotation and a conveying direction parallel to the axis of rotation, said screw flight having a front side facing in the conveying direction and including a radially outer portion leading to an outer edge that runs transversely to the conveying direction, comprising:

a wearing part;

a support having a first side securable to said radially outer portion of said front side of a screw press flight, an angled profile for engaging said outer edge of the flight, and a second side opposite the first side and connected to the wearing part by a positive bond and a substance-to-substance bond;

wherein said positive bond includes a recess in one of the support or wearing part aligned in a direction between the first and second sides of the support and a pin projection in the other of said support or wearing part aligned in a direction between the first and second sides of the support such that the pin projection closely conforms with said recess;

wherein the wearing part has a flat wearing surface that is transverse to the aligned pin projection and faces the conveying direction; and wherein said substance to substance bond is a soldered joint connecting the support and the wearing part in the region of the recess and the recess and the pin projection have corresponding cross sectional shapes such that the pin projection meshes with and is completely enclosed by the recess.

2. A wear attachment according to claim 1, wherein the wearing part (6) is made of hard metal.

3. A wear attachment according to claim 1, wherein the soldered joint between the support (7) and the wearing part (6) is a brazed joint.

4. A wear attachment according to claim 1, wherein the projection (8) is provided at the wearing part (6) and the recess (9) in the support (7).

5. A wear attachment according to claim 1, wherein the projection (8) is provided at the support (7) and the recess (9) in the wearing part (6).

6. A wear attachment according to claim 1, wherein the support (7) is a supporting strip, on which several wearing parts (6) are mounted.

7. A wear attachment according to claim 1, wherein the projection (8) is a round or polygonal pin.

8. A wear attachment according to claim 2, wherein the soldered joint between the support (7) and wearing part (6) is a brazed joint.

9. A wear attachment according to claim 6, wherein the projection (8) is a round or polygonal pin or a strip.

10. A wear attachment according to claim 1, wherein the support (7) includes a nose projecting from the second side and the wearing part (6) rests on said nose.

11. A wear attachment according to claim 1, wherein the support and the wearing part are different materials.

* * * * *